United States Patent [19]

Polan

[11] Patent Number: 4,976,320

[45] Date of Patent: Dec. 11, 1990

[54] CONCEALED SPRINKLER WITH DROP DOWN DEFLECTOR ASSEMBLY, AND IMPROVED FUSIBLE VALVE LEVER ASSEMBLY

[75] Inventor: George S. Polan, Harleysville, Pa.

[73] Assignee: Central Sprinkler Corporation, Lansdale, Pa.

[21] Appl. No.: 356,740

[22] Filed: May 25, 1989

[51] Int. Cl.[5] ..... A62C 37/08

[52] U.S. Cl. ..... 169/39; 169/37; 169/38; 169/40

[58] Field of Search ..... 169/37, 40, 38, 39, 169/42, 90

[56] References Cited

U.S. PATENT DOCUMENTS

| | | | |
|---|---|---|---|
| 506,704 | 10/1893 | Lynde | 169/40 |
| 506,929 | 10/1893 | Newton | 169/39 |
| 1,816,016 | 7/1931 | Knight | 169/42 |
| 2,558,450 | 6/1951 | Martin | 169/37 |
| 3,195,647 | 7/1965 | Campbell et al. | 169/37 |
| 3,633,676 | 1/1972 | Gloeckler | 169/40 |
| 3,756,321 | 9/1973 | Gloeckler | 169/40 |
| 4,014,388 | 3/1977 | Anderson | 169/37 |
| 4,015,665 | 4/1977 | Simons et al. | 169/40 |
| 4,105,076 | 8/1978 | Simons et al. | 169/38 |
| 4,217,960 | 8/1980 | Miyazaki | 169/38 |
| 4,596,289 | 6/1986 | Johnson | 169/37 |
| 4,618,002 | 10/1986 | Mears | 169/37 |
| 4,766,961 | 8/1988 | Macie | 169/38 |
| 4,785,888 | 11/1988 | Blum et al. | 169/42 |

FOREIGN PATENT DOCUMENTS

| | | | |
|---|---|---|---|
| 648027 | 9/1962 | Canada | 169/38 |
| 20421 | of 1890 | United Kingdom . | |
| 313 | of 1895 | United Kingdom . | |
| 343806 | 2/1931 | United Kingdom . | |
| 346984 | 4/1931 | United Kingdom | 169/39 |
| 1359857 | 7/1974 | United Kingdom | 169/38 |

*Primary Examiner*—Sherman Basinger
*Assistant Examiner*—Christopher P. Ellis
*Attorney, Agent, or Firm*—Panitch Schwarze Jacobs & Nadel

[57] ABSTRACT

A concealed sprinkler with drop down deflector assembly includes a pair of frame arms which resemble a tuning-fork, there being a gap between the free end portions of the arms. As a result, the arms are not subject to assembly loads or system pressure loads. The drop down deflector assembly is mounted on the end portions of the arms. A preferred valve assembly includes a valve and a compound lever arrangement for holding a rigid thermal responsive element, such as a frangible glass bulb, and for adjusting compressive preload on the valve without loading the frame arms.

12 Claims, 3 Drawing Sheets

CONCEALED SPRINKLER WITH DROP DOWN DEFLECTOR ASSEMBLY, AND IMPROVED FUSIBLE VALVE LEVER ASSEMBLY

FIELD OF THE INVENTION

The invention relates to the field of fire sprinkler equipment, specifically, concealed sprinklers, sprinklers having drop down deflector assemblies, sprinklers utilizing a frangible glass bulb as the thermal responsive element, and sprinklers including a mechanism for adjusting the compressive pre-load on the sprinkler valve.

BACKGROUND OF THE INVENTION

Sprinklers employing drop down deflector assemblies are well-known. See U.S. Pat. Nos. 4,217,960 and 4,014,388. U.S. Pat. No. 4,217,960 discloses a concealed type sprinkler having a slotted cylindrical frame 7 threaded on a body 1. A deflector 14 is mounted on guide pins 12 which extend through bores in the frame bottom wall. A valve assembly 10 is secured to the deflector and loaded by a lever mechanism between the body outlet and frame bottom wall. The frame bottom wall is provided with a central opening through which the valve assembly can drop with the deflector. U.S. Pat. No. 4,014,388 discloses a concealed type sprinkler having a spring urged drop down deflector 17 whose guide pins 15, 16 extend through bores in frame arms 5, 6. The frame arms are part of a yoke frame integral with a body 1 and are loaded by a thermal element 8 between the body outlet and a compression screw 24.

U.S. Pat. No. 2,558,450 discloses a concealed type sprinkler having a yoke (26, 27) shaped as a tuning fork with an arm 62 bridging the yoke bight. Arm 62 is provided with a compression screw 49 and is mounted on the yoke at grooves 65 or on balls 71.

U.S. Pat. Nos. 4,596,289, 4,105,076, 4,015,665, 3,756,321 and 3,633,676 also disclose drop down deflectors. In these patents, the deflector is mounted on a pair of guide pins along the flange portion of a sprinkler body. U.S. Pat. No. 4,596,289 discloses a drop down valve 32 and deflector 22 mounted on guide pins 40, 42 along a sprinkler body flange 24. The flange can be separately manufactured and secured to the sprinkler body 12. U.S. Pat. No. 4,105,076 discloses a drop down valve 5 and deflector 12 mounted on guide pins 14 along a sprinkler body 16. U.S. Pat. No. 4,015,665 shows the same drop down valve and deflector construction as in U.S. Pat. No. 4,105,076. U.S. Pat. No. 3,756,321 discloses a drop down deflector 33 mounted on guide pins 31 along a sprinkler body flange 22. U.S. Pat. No. 3,633,676 discloses a drop down deflector 34 mounted on guide pins 29 along a sprinkler body flange.

U.S. Pat. Nos. 4,766,961 and 4,618,002 also disclose drop down deflectors mounted on guide pins along a sprinkler body flange U.S. Pat. No. 4,766,961 discloses a drop down valve 13 and a deflector 16 mounted on guide pins 17 along a sprinkler body flange 19. U.S. Pat. No. 4,618,002 discloses a drop down valve 30 and deflector 36 mounted on guide pins 38 along a sprinkler body flange 12.

Various sprinkler valve lever mechanisms are also well-known. For example U.K. patent No. 313 discloses a triple compound lever arrangement wherein a link g and lever h are fulcrumed along an annular shoulder in the sprinkler housing. Apparently, the lever is pivoted by the advance of an adjustment screw 1. U.K. patent No. 20,421 discloses a double compound lever arrangement wherein an upper lever f is pivotably mounted on a lip b, of a sprinkler cover, a lower lever g is pivotably mounted on the same lip b', the other end of the lever f is fulcrumed on the lever g, and the lever g is supported at its other end on a washer i coupled to a soldered tube arrangement k, 1 outside the sprinkler body. U.K. patent No. 343,806 discloses the general concept of a pair of fulcrum arms a, b captured by a clamp e. The arms hold a sprinkler bulb d in compression. Canadian patent No. 648,027 discloses a pair of lever arms 20 which: retain a valve cover plate 16 in position while holding a bulb 22 in compression. The lever arms are fulcrumed in the cover plate. U.K. patent No. 1,359,857 discloses a control valve for an open sprinkler head. A valve plug 24 is pre-loaded by a pivotable strut and a cam 30. A glass bulb 38 is pre-loaded between strut 35 and opposing (pivotable) strut 36. Strut 35 is pivotable about a notch 34 in a housing arm 28. Strut 36 is pivotable about a screw 41 in a housing 29. U.K. patent No. 347,984 discloses a bulb h pre-loaded between arms a1, b1 of a balanced pair of levers a, b. U.S. Pat. No. 3,195,647 discloses a pair of levers 40 which hold a fusible link 38 in tension while maintaining a valve 22 sealed against a sprinkler valve seat. The amount of tension exerted on the fusible link is set by deforming a portion of the sprinkler frame by a ran 50.

The present invention provides a solution to the problem of providing for adjustable compressive pre-load of a valve in a sprinkler utilizing a. rigid thermal responsive element, such as a frangible glass bulb, without loading the frame arms. As a result, the frame arms may be made lighter or of less bulk without affecting sprinkler operation.

SUMMARY OF THE INVENTION

A concealed sprinkler with drop down deflector assembly comprises a body having a passage with an inlet and an outlet for conducting flow of pressurized fluid. A frame is connected to the body, and the frame has opposed arms. Each arm depends from the body and has a free end portion. The free end portions of the arms are separated by a gap so that the arms are not subjected to assembly loads or system pressure loads. A drop down deflector assembly is mounted on the free end portions of the arms so as to be displaceable from a first elevation to a second, lower elevation. The gap permits undistorted water column flow directly to the deflector assembly.

A valve assembly is provided for sealing the passage outlet. Preferably, the valve assembly includes a compound lever assembly having expandable jaws for holding a rigid thermal responsive element. The compound lever assembly is moveable upwardly against a valve upon expansion of the jaws. Means are provided for adjusting compressive pre-load on the valve by expanding the jaws to cause the compound lever assembly to move upwardly against the valve.

For the purpose of illustrating the invention, there is shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
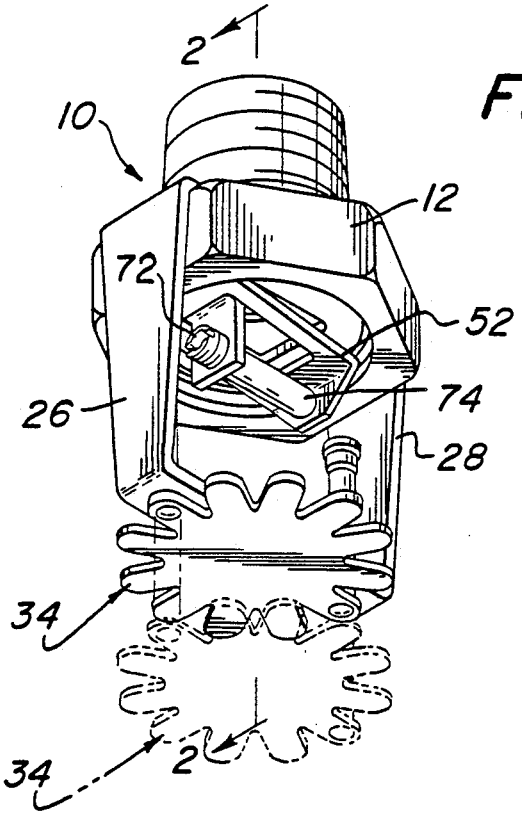
FIG. 1 is a perspective of a concealed sprinkler with drop down deflector assembly according to the present invention wherein the sprinkler body and frame are discrete units.
Figure 2:
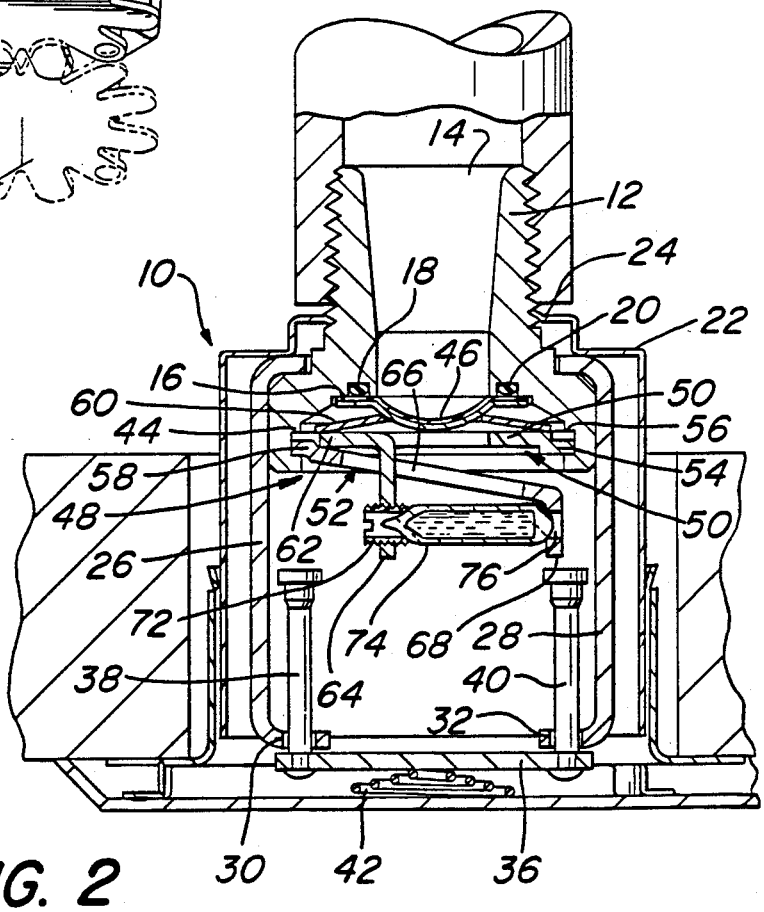
FIG. 2 is a vertical section taken along 2—2 in FIG. 1 showing the sprinkler prior to activation.
Figure 3:
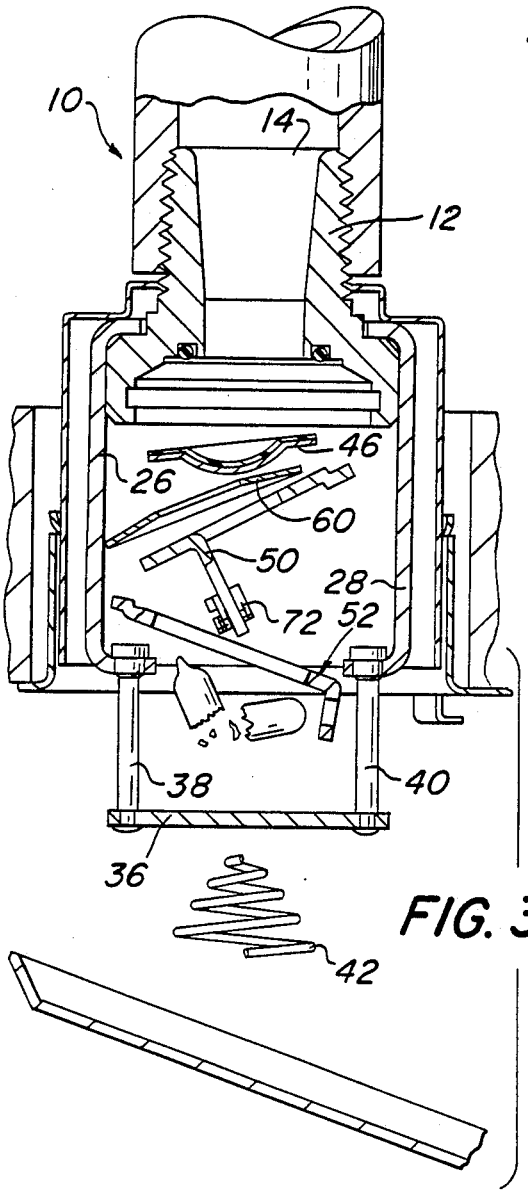
FIG. 3 is a vertical section taken along 2—2 in FIG. 1 showing the sprinkler after activation.
Figure 4:
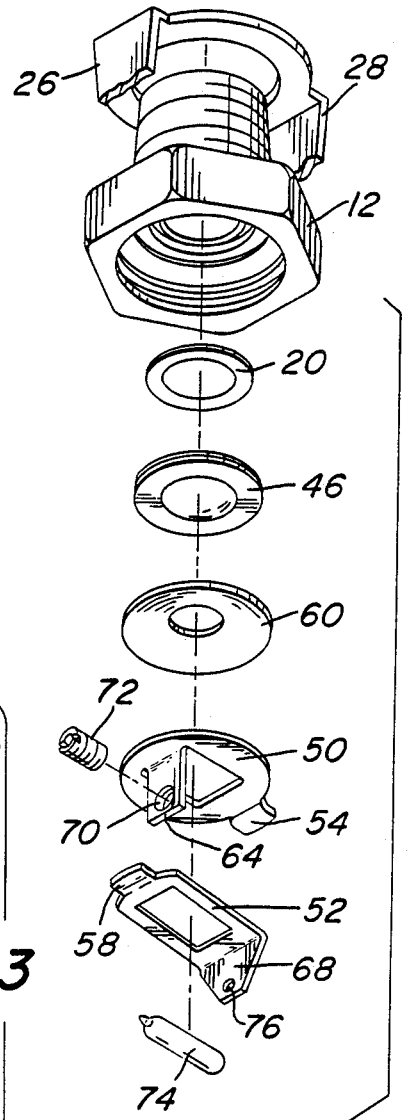
FIG. 4 is an exploded isometric of the components of the sprinkler shown in FIG. 1.

Referring to the drawings, wherein like numerals indicate like elements, there is shown in FIG. 1 a sprinkler according to the present invention designated generally as 10. Sprinkler 10 includes a body 12 having a passage 14 with an inlet and an outlet for conducting flow of pressurized fluid. A valve seat 16 is formed on the body at the region of the outlet. An annular groove 18 is formed in the valve seat, and an O-ring seal 20 is lodged in the groove.

A separate, discrete frame 22, formed of stamped metal, has a threaded collar 24 and a pair of opposed arms 26, 28. The frame is threaded onto body 12 so that arms 26, 28 depend from the body. Each arm has a free end portion 30, 32. The free end portions of the arms are separated by a gap whereby the arms are not subjected to assembly loads or system pressure loads.

A drop down deflector assembly 34 is mounted on the free end portions 30, 32 of the arms 26, 28 so as to be displaceable from a first elevation shown in solid lines in FIG. 1 (prior to activation of the sprinkler) to a second, lower elevation shown in phantom in FIG. 1 (after activation of the sprinkler). The drop down deflector assembly includes a deflector plate 36 coupled to a pair of guide pins 38, 40 journaled in the free end portions of the arms. A spring 42 is provided beneath the deflector plate so as to yieldingly urge the deflector assembly to the first elevation (solid line position in FIG. 1). The spring is located between the deflector plate 36 and a ceiling cover which drops away at elevated temperatures. The elevated temperatures cause a (lower temperature rated) solder joint between the cover plate and a support ring to melt prior to activation of a valve assembly 44. The cover plate and support ring are conventional elements of the concealed type sprinkler.

The valve assembly 44 seals the outlet of passage 14. The valve assembly includes a disc-shaped Mylar TM coated valve 46 with a central concavity. A compressive pre-load is exerted on valve 46, urging the valve against the valve seat 16, to seal the outlet of passage 14.

The valve assembly includes a compound lever assembly 48. The lever assembly includes expandable jaws which capture a thermal responsive element such as a frangible glass bulb therebetween. The compound lever assembly is moveable upwardly against the valve 46 upon expansion of the jaws as described hereinafter. The compressive pre-load on the valve is adjusted by expanding the jaws to cause the compound lever assembly to move upwardly against the valve.

More particularly, the compound lever assembly includes an upper lever 50 and a lower lever 52. Upper lever 50 is pivotably mounted at an end portion 54 thereof in an annular groove 56 formed in body 12. Lower lever 52 is pivotably mounted at an end portion 58 thereof in the same annular groove. An annular spring washer 60 is disposed between valve 46 and lever 50 although, if desired, the spring washer can be dispensed with. Upper lever 50 is supported along an end portion 62 thereof by lower lever 52 such that upward pivoting movement of the lower lever causes upward pivoting movement of the upper lever thereby exerting a compressive pre-load' on valve 46 via spring washer 60. Upper lever 50 is provided with a down-turned tab or jaw 64 which extends through an opening 66 in lower lever 52. The lower lever is provided with a down-turned end portion or jaw 68. Jaw 64 is provided with a threaded opening 70 for accepting a load screw 72. The threaded opening is sized so as to receive the jet end portion of a rigid thermal responsive element 74 in the form of a frangible glass bulb containing a heat expandable fluid such as alcohol. Jaw 68 is provided with an opening 76 for receiving the other end of element 74. Advancing load screw 72 in opening 70 (to the right in FIG. 1) displaces the thermal responsive element 74 so as to cause the jaws 64, 68 to expand whereby the lower lever 52 pivots upwardly. As a result, upper lever 50 is pivoted upwardly against valve 46 thereby increasing the compressive pre-load on the valve. To reduce the compressive pre-load on the valve, the load screw 72 is backed off (to the left in FIG. 1) so as to close the jaws incrementally.

It should be readily appreciated that the compound lever assembly of the present invention enables adjustment of the compressive pre-load on valve 46 over a relatively wide range with relatively little displacement of the load screw 72.

The compound lever assembly 48 of the present invention is preferred for capturing the thermal responsive element 74, and for adjusting the compressive preload on valve 46, because it is particularly suited for use with the frame arm arrangement of the invention wherein the fame arms are not loaded, i.e., wherein the frame arms are not used to capture the thermal responsive element or to pre-load the valve.

Figure 5:
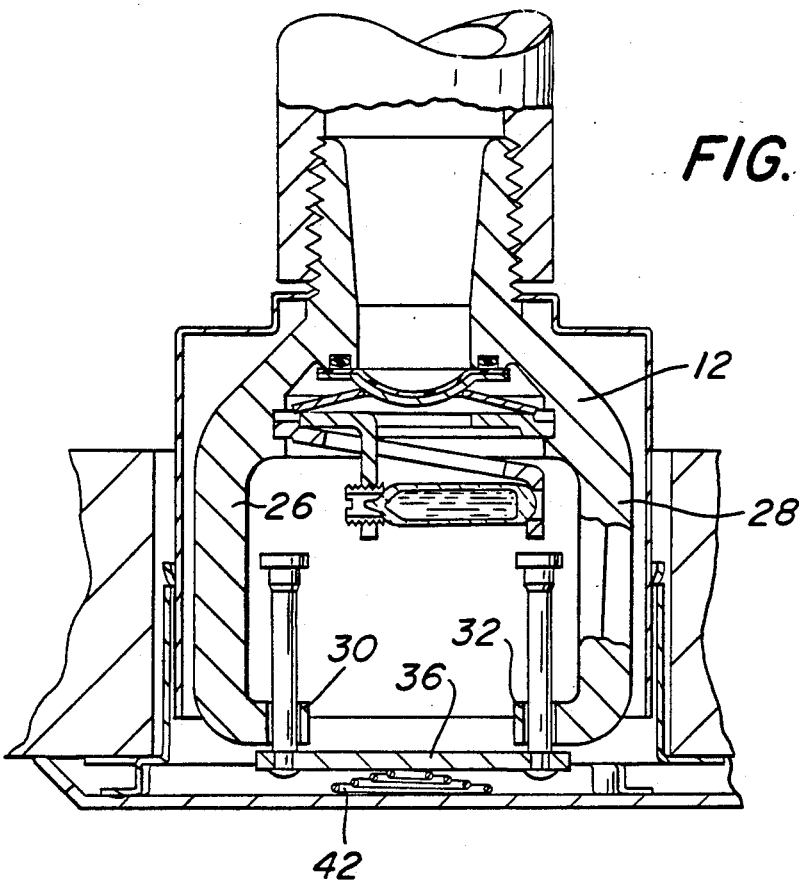
FIG. 5 is a vertical section of a sprinkler according to the present invention wherein the body and frame are a single cast unit.

Referring to FIG. 5, there is shown a vertical section of an alternate embodiment of the invention wherein the body 12 and frame 22 are a single cast unit. The structure and operation of the embodiment shown in FIG. 5 is otherwise identical to that previously described.

Figure 6:
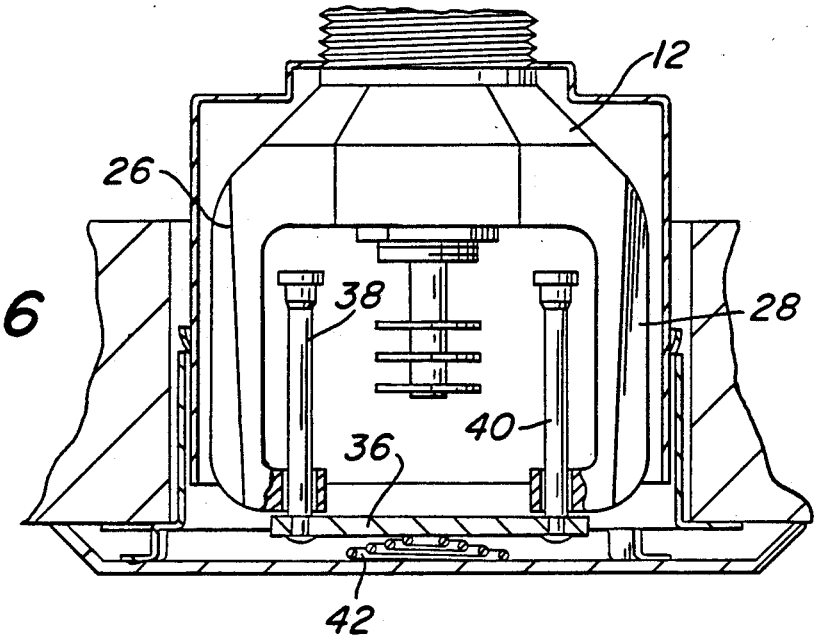
FIG. 6 is a vertical section of a sprinkler according to the present invention utilizing a conventional valve assembly.

Although the invention has been described in terms of a pair of frame arms arranged so as to avoid subjecting the arms to loads, in conjunction with a preferred valve assembly and compound lever arrangement, it should be understood that the preferred frame arm arrangement and preferred valve assembly may be utilized separately. For example, in FIG. 6, there is shown a sprinkler utilizing the frame arm arrangement of the present invention, including the drop down deflector assembly, but a conventional valve assembly.

The present invention may be embodied in other specific forms without departing from the spirit or essential attributes thereof and, accordingly, reference should be made to the appended claims, rather than to the foregoing specification, as indicating the scope of the invention.

I claim:

1. Concealed sprinkler with drop down deflector assembly, comprising:

a body having a passage with an inlet and an outlet for conducting flow of pressurized fluid, a valve assembly for sealing the passage outlet, a frame connected to the body and having opposed arms, each arm depending from the body and having a free end portion, the free end portions of the arms being separated by a gap so that the arms are not subjected to assembly loads or system pressure loads, and a drop down deflector assembly mounted on said free end portions of said arms so as to be displaceable from a first elevation to a second, lower elevation.

2. Concealed sprinkler according to claim 1 wherein the gap between said free end portions of said arms is greater than the inner diameter of said passage at its outlet.

3. Concealed sprinkler according to claim 3 wherein said body and frame are a single cast unit.

4. Concealed sprinkler according to claim 1 wherein said body and frame are discrete units provided with means for fastening the frame and

5. Concealed sprinkler according to claim 1 wherein said drop down deflector assembly includes a deflector plate coupled to a pair of guide pins journaled in said free end portions of said arms, and means for yieldingly urging said deflector plate to said first elevation.

6. A sprinkler, comprising:

a body having a passage with an inlet and an outlet for conducting flow of pressurized fluid, said body having a valve seat at the region of the outlet, a valve assembly for sealing the passage outlet including a compound lever assembly, said compound lever assembly including expandable jaws for holding a rigid thermal responsive element therebetween, said compound lever assembly being moveable upwardly against a valve upon expansion of the jaws, and means for adjusting compressive pre-load on the valve by expanding the jaws to cause the compound lever assembly to move upwardly against the valve.

7. A sprinkler, comprising:

a body having a passage with an inlet and an outlet for conducting flow of pressurized fluid, said body having a valve seat at the region of the outlet, a valve assembly for sealing the passage outlet including an upper lever and a lower lever, each pivotably mounted at an end portion thereof to the body, a valve supported by said upper lever, the upper lever being supported along another end portion thereof by the lower lever such that upward pivoting movement of said lower lever causes upward pivoting movement of said upper lever against the valve, said upper and lower levers having jaws for holding a rigid thermal responsive element therebetween, said jaws being expandable upon upward pivoting movement of the lower lever, and means for adjusting compressive pre-load on said valve against the valve seat by expanding said jaws to cause said upper lever to pivot upwardly against the valve.

8. A sprinkler according to claim 6 or claim 7 wherein said means for adjusting compressive pre-load includes means for displacing said thermal responsive element held by said jaws.

9. A sprinkler according to claim 6 including a spring washer between said compound lever assembly and valve.

10. A sprinkler according to claim 7 including a spring washer between said upper lever and said valve.

11. A sprinkler with drop down deflector assembly, comprising:

a body having a passage with an inlet and an outlet for conducting flow of pressurized fluid, a valve assembly for sealing the passage outlet, a frame connected to the body and having opposed arms, each arm depending from the body and having a free end portion, the arm free end portions being separated by a gap so that the arms are not subjected to assembly loads or system pressure loads, a drop down deflector assembly mounted on said free end portions of said arms so as to be displaceable from a first elevation to a second, lower elevation, said valve assembly including a compound lever assembly, said compound lever assembly including expandable jaws for holding a rigid thermal responsive element therebetween, said compound lever assembly being moveable upwardly against a valve upon expansion of the jaws, and means for adjusting compressive pre-load on the valve by expanding the jaws to cause the compound lever assembly to move upwardly against the valve.

12. A sprinkler with drop down deflector assembly, comprising:

a body having a passage with an inlet and an outlet for conducting flow of pressurized fluid, a valve assembly for sealing the passage outlet, a frame connected to the body and having opposed arms, each arm depending from the body and having a free end portion, the arm free end portions being separated by a gap so that the arms are not subjected to assembly loads or system pressure loads, a drop down deflector assembly mounted on said free end portions of said arms so as to be displaceable from a first elevation to a second, lower elevation, said valve assembly including an upper lever and a lower lever each pivotably mounted at an end portion thereof to the body, a valve supported by said upper lever, the upper lever being supported along another end portion thereof by the lower lever such that upward pivoting movement of said lower lever causes upward pivoting movement of said upper lever against the valve, said upper and lower levers having jaws for holding a rigid thermal responsive element therebetween, said jaws being expandable upon upward pivoting movement of said lower lever, and means for adjusting compressive pre-load on said valve against the valve seat by expanding said jaws to cause said upper lever to pivot upwardly against the valve.

* * * * *

US004976320C1

(12) EX PARTE REEXAMINATION CERTIFICATE (6611th)

United States Patent

Polan

(10) Number: US 4,976,320 C1

(45) Certificate Issued: Jan. 13, 2009

(54) CONCEALED SPRINKLER WITH DROP DOWN DEFLECTOR ASSEMBLY, AND IMPROVED FUSIBLE VALVE LEVER ASSEMBLY

(75) Inventor: George S. Polan, Harleysville, PA (US)

(73) Assignee: Central Sprinkler Company, Lansdale, PA (US)

Reexamination Request:
No. 90/008,582, Apr. 18, 2007

Reexamination Certificate for:

| | |
|---|---|
| Patent No.: | **4,976,320** |
| Issued: | **Dec. 11, 1990** |
| Appl. No.: | **07/356,740** |
| Filed: | **May 25, 1989** |

(51) Int. Cl.
*A62C 37/08* (2006.01)

(52) U.S. Cl. ..... 169/39; 169/37; 169/38; 169/40

(58) Field of Classification Search ..... None
See application file for complete search history.

(56) References Cited

U.S. PATENT DOCUMENTS

| | | | |
|---|---|---|---|
| 306,662 | A | 10/1884 | Stratton |
| 1,816,016 | A | 7/1931 | Knight |
| 2,558,450 | A | 6/1951 | Martin |
| 3,195,647 | A | 7/1965 | Campbell et al. |
| 4,015,665 | A | 4/1977 | Simons et al. |
| 4,066,129 | A | 1/1978 | Anderson |
| 4,139,062 | A | 2/1979 | Rago et al. |
| 4,630,682 | A | 12/1986 | Pieczykolan |
| 4,880,063 | A | 11/1989 | Leininger et al. |

FOREIGN PATENT DOCUMENTS

| | | |
|---|---|---|
| GB | 2195241 | 4/1988 |
| JP | 49-63798 | 9/1947 |

*Primary Examiner*—Aaron J. Lewis

(57) ABSTRACT

A concealed sprinkler with drop down deflector assembly includes a pair of frame arms which resemble a tuning-fork, there being a gap between the free end portions of the arms. As a result, the arms are not subject to assembly loads or system pressure loads. The drop down deflector assembly is mounted on the end portions of the arms. A preferred valve assembly includes a valve and a compound lever arrangement for holding a rigid thermal responsive element, such as a frangible glass bulb, and for adjusting compressive preload on the valve without loading the frame arms.

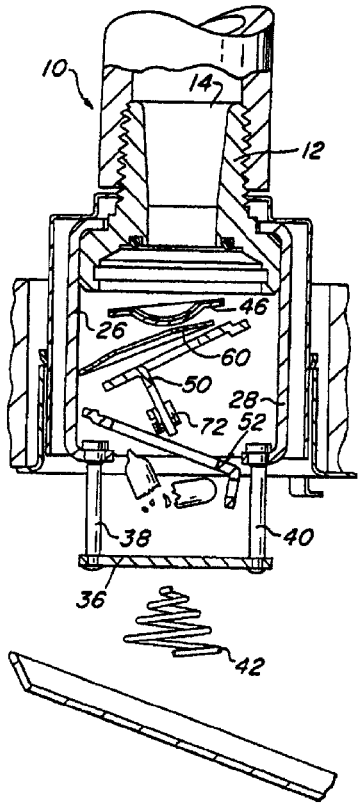

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–3, 5 and 11 is confirmed.

Claims 6 and 9 are cancelled.

Claim 8 is determined to be patentable as amended.

Claims 4, 7, 10 and 12 were not reexamined.

8. A sprinkler according to [claim 6 or] claim 7 wherein said means for adjusting compressive pre-load includes means for displacing said thermal responsive element held by said jaws.

* * * * *

US004976320C2

(12) EX PARTE REEXAMINATION CERTIFICATE (7946th)

United States Patent
Polan

(10) Number: US 4,976,320 C2
(45) Certificate Issued: Dec. 21, 2010

(54) CONCEALED SPRINKLER WITH DROP DOWN DEFLECTOR ASSEMBLY, AND IMPROVED FUSIBLE VALVE LEVER ASSEMBLY

(75) Inventor: George S. Polan, Harleysville, PA (US)

(73) Assignee: Central Sprinkler Company, Lansdale, PA (US)

Reexamination Request:
No. 90/010,304, Oct. 6, 2008

Reexamination Certificate for:

| | |
|---|---|
| Patent No.: | **4,976,320** |
| Issued: | **Dec. 11, 1990** |
| Appl. No.: | **07/356,740** |
| Filed: | **May 25, 1989** |

Reexamination Certificate C1 4,976,320 issued Jan. 13, 2009

(51) Int. Cl.
*A62C 37/08* (2006.01)

(52) U.S. Cl. ..... 169/39; 169/37; 169/38; 169/40

(58) Field of Classification Search ..... None
See application file for complete search history.

(56) References Cited

U.S. PATENT DOCUMENTS

| | | | |
|---|---|---|---|
| 2,558,450 | A | 6/1951 | Martin |
| 3,834,462 | A | 9/1974 | Orloff et al. |
| 4,015,665 | A | 4/1977 | Simons et al. |
| 4,491,182 | A | 1/1985 | Pieczykolan |
| 4,508,175 | A | 4/1985 | Pieczykolan |
| 4,732,216 | A | 3/1988 | Polan |
| 4,976,320 | A | 12/1990 | Polan |

*Primary Examiner*—Aaron J. Lewis

(57) ABSTRACT

A concealed sprinkler with drop down deflector assembly includes a pair of frame arms which resemble a tuning-fork, there being a gap between the free end portions of the arms. As a result, the arms are not subject to assembly loads or system pressure loads. The drop down deflector assembly is mounted on the end portions of the arms. A preferred valve assembly includes a valve and a compound lever arrangement for holding a rigid thermal responsive element, such as a frangible glass bulb, and for adjusting compressive preload on the valve without loading the frame arms.

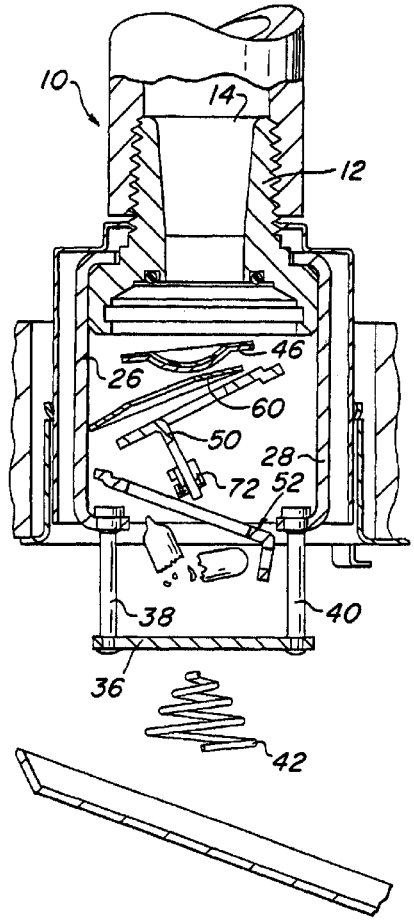

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1-3 and 5 is confirmed.
Claims 6 and 9 were previously cancelled.
Claims 4, 7, 8 and 10-12 were not reexamined.

* * * * *